US008419316B2

(12) United States Patent
Hodge

(10) Patent No.: US 8,419,316 B2
(45) Date of Patent: Apr. 16, 2013

(54) TRIPLE-PRONGED GROUND IMPROVEMENT TOOL AND DEPLOYMENT ARRAY

(76) Inventor: William Eugene Hodge, Lumby (CA)

( * ) Notice: Subject to any disclaimer, the term of this patent is extended or adjusted under 35 U.S.C. 154(b) by 0 days.

(21) Appl. No.: 12/837,756

(22) Filed: Jul. 16, 2010

(65) Prior Publication Data

US 2011/0170959 A1 Jul. 14, 2011

Related U.S. Application Data

(60) Provisional application No. 61/260,625, filed on Nov. 12, 2009.

(51) Int. Cl.
*E02D 3/02* (2006.01)

(52) U.S. Cl.
USPC ..... 405/271

(58) Field of Classification Search ..... 405/232, 405/233, 263, 270, 271
See application file for complete search history.

(56) References Cited

U.S. PATENT DOCUMENTS

| | | | | |
|---|---|---|---|---|
| 3,830,317 | A * | 8/1974 | Perkins | 175/72 |
| 4,397,590 | A * | 8/1983 | Friesen et al. | 405/271 |
| 5,118,223 | A * | 6/1992 | Taki | 405/267 |
| 5,160,220 | A * | 11/1992 | Yoshida et al. | 405/236 |
| 5,328,299 | A * | 7/1994 | Degen et al. | 405/240 |
| 6,554,543 | B2 * | 4/2003 | Hodge | 405/271 |
| 6,733,207 | B2 * | 5/2004 | Penza et al. | 405/128.25 |

FOREIGN PATENT DOCUMENTS

JP 06073723 A * 3/1994

* cited by examiner

*Primary Examiner* — David Bagnell
*Assistant Examiner* — Kyle Armstrong
(74) *Attorney, Agent, or Firm* — C. Larry Kyle; Nexus Law Group LLP

(57) ABSTRACT

The proposed method involves deploying and activating three ground improvement machines together in a triangular array, rather than a single machine working alone in isolation. The machines are of the type both capable of producing vibratory excitation, and also a pump capable of creating fluid flow, in the ground at depth. Each of the three machines is independently controlled so as to create ground vibrations which are either in, or out, of phase, and at the same time create the hydraulic gradient required to cause fluid flow and seepage forces in the ground within their compass.

4 Claims, 4 Drawing Sheets

TRIPLE-PRONGED GROUND IMPROVEMENT TOOL AND DEPLOYMENT ARRAY

CROSS-REFERENCE TO RELATED APPLICATIONS

This application claims priority under 35 U.S.C 119(e) to U.S. Provisional Patent application No. 61/260,625 filed Nov. 12, 2009, the disclosure of which is incorporated herein by reference.

FIELD OF THE INVENTION

The method described herein is believed to constitute a substantial improvement over those currently in use by that branch of the Civil Engineering construction industry referred to as Ground Improvement. The method involves employing a set of three individual ground improvement machines, preferably structurally interconnected in a triangular configuration to become a single composite tool, such that this new three-pronged composite machine can be mounted on, and supported by, a single deployment conveyance in a manner to allow their simultaneous insertion into (and subsequent withdrawal from) the ground.

The machines required to achieve this improvement are of the type described in U.S. Pat. No. 6,554,543 or similar, which have the means of both producing vibrations and of creating fluid flow in the surrounding ground at depth.

BACKGROUND

In order to improve the engineering characteristics (the geotechnical parametric values) of the ground underlying a building site prior to construction, specialist contractors referred to as Ground Improvement [hereinafter abbreviated to "GI"] contractors, operate on the ground using one or other of a variety of pieces of equipment specifically designed and built for this purpose. In many cases the GI contractor will select a machine which consists of a long cylindrical (pipe-like) tool such as the Vibroflot which has been in use since the 1930s. This long tool is sometimes referred to as a poker because of its shape and its use of agitation to improve the situation.

To treat the subject ground and improve its consistency to the depth required by the design engineer, the poker is inserted to an appropriate depth and then caused to exert forces on the soil around it, and in which it is embedded, while it is being withdrawn from the ground. In most cases the treatment force used is vibratory. In the particular case of equipment described in U.S. Pat. No. 6,554,543, the disclosure of which is incorporated herein by reference, the treatment forces are a combination of vibratory and hydrodynamic.

SUMMARY OF THE INVENTION

According to a preferred embodiment of the invention there is provided a method of ground improvement using a deployment vehicle equipped with a plurality of ground improvement machines, each of the ground improvement machines comprising a tubular poker member for insertion into the ground, the poker member adapted to vibrate at different frequencies selected by a user and to inject or withdraw liquid, the method comprising deploying the ground improvement machines in a triangular array into a portion of the ground, with at least one of the plurality of ground improvement machines operating to pump fluid into the ground and at least one other of the plurality of ground improvement machines operating to withdraw fluid out of the ground. In another aspect, the ground improvement machines can be set to vibrate at the same or different frequencies.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

These and other features of the invention will become more apparent from the following description in which reference is made to the appended drawings and wherein.

DESCRIPTION OF THE PREFERRED EMBODIMENTS

Prior Art

Figure 1:
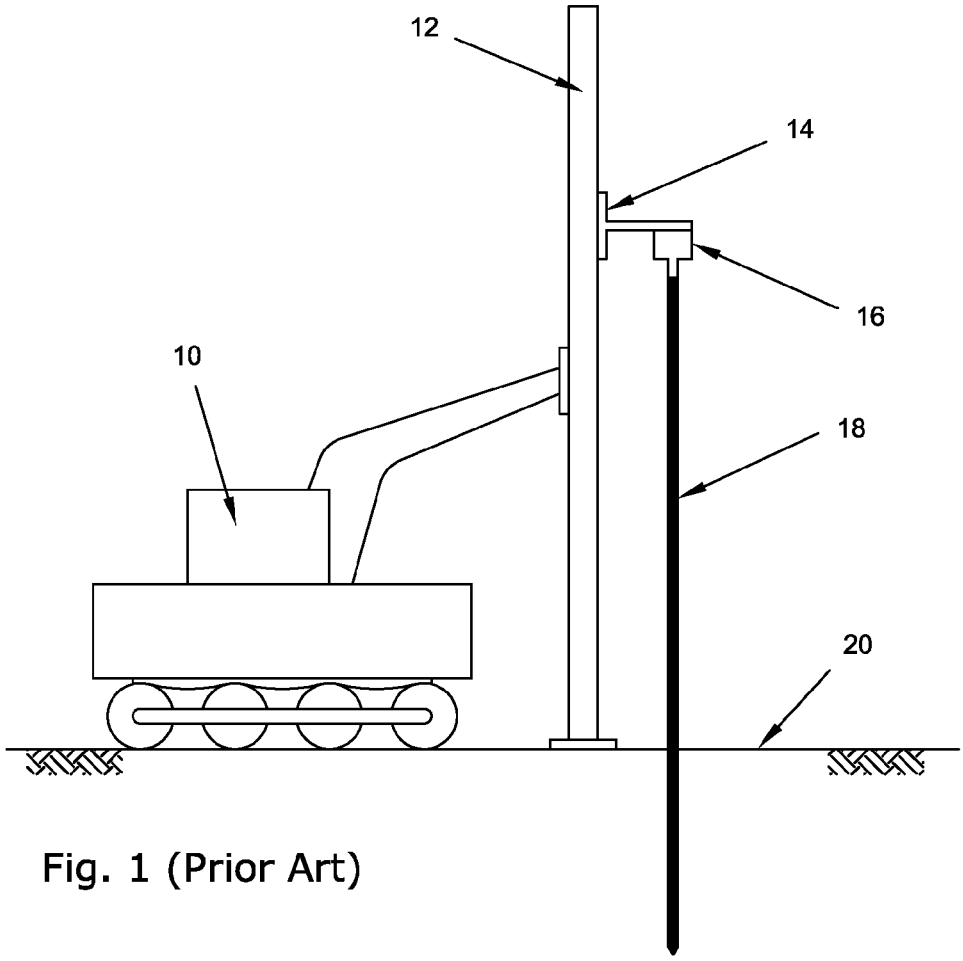
Fig. 1 (Prior Art)
FIG. 1 is a side view of a deployment vehicle equipped with a ground improvement machine according to the prior art.
Figure 2:
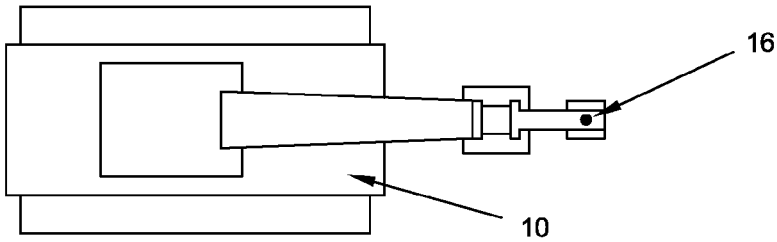
Fig. 2 (Prior Art)
FIG. 2 is a top view of the prior art deployment vehicle and ground improvement machine shown in FIG. 1.

As taught in U.S. Pat. No. 6,554,543, and illustrated in FIGS. 1 and 2, a deployment vehicle 10 equipped with mast 12 supporting a vertical drive piston 14 to which is connected a ground improvement machine in the form of poker head 16 and poker 18 can be deployed for ground improvement purposes. The poker 18 is inserted into the ground 20 and vibrates so as to compact the ground. In addition, it can act to withdraw water or liquid from the ground 20.

Figure 3:
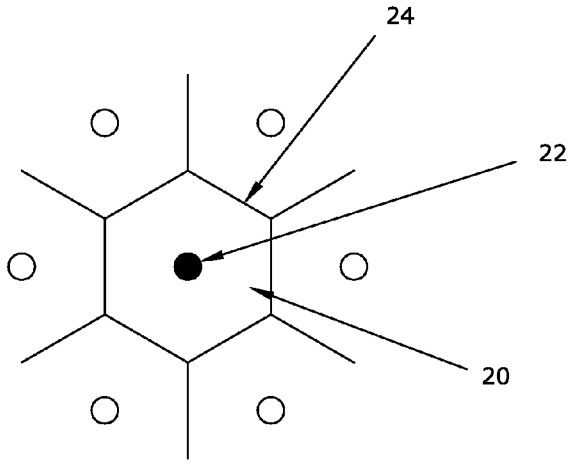
Fig. 3 (Prior Art)
FIG. 3 is a top view showing ground affected by the single ground improvement machine shown in FIG. 1 as known in the prior art.
Figure 4:
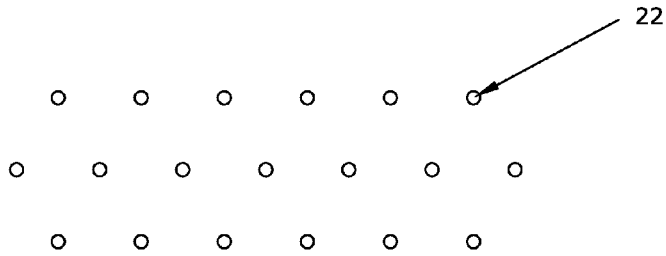
Fig. 4 (Prior Art)
FIG. 4 is a top view showing a deployment pattern for the ground improvement machine of FIG. 1 as known in the prior art.
Figure 5:
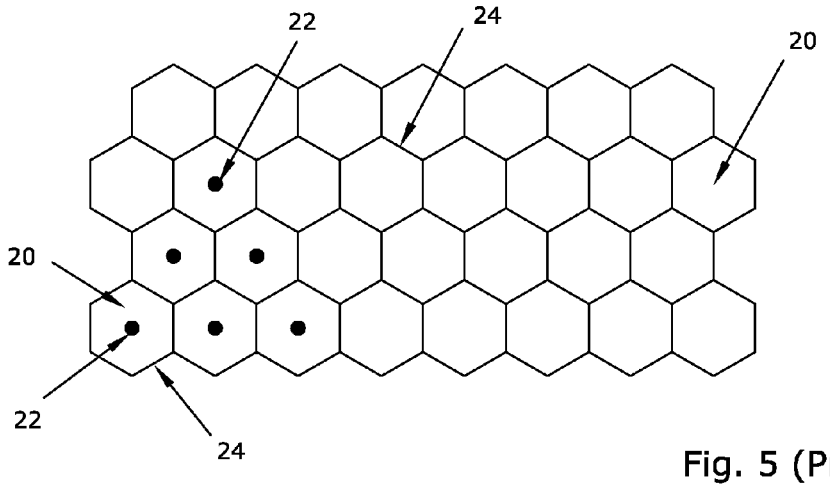
Fig. 5 (Prior Art)
FIG. 5 is a top view showing an expanded view of the prior art deployment pattern of FIG. 4.

Various deployment patterns showing ground affected by insertion of the poker 18 are illustrated in FIGS. 3-5. Insertion of the poker in location 22 in ground 20 results in an effective affected area outlined by border 24.

Description of Apparatus

Figure 6:
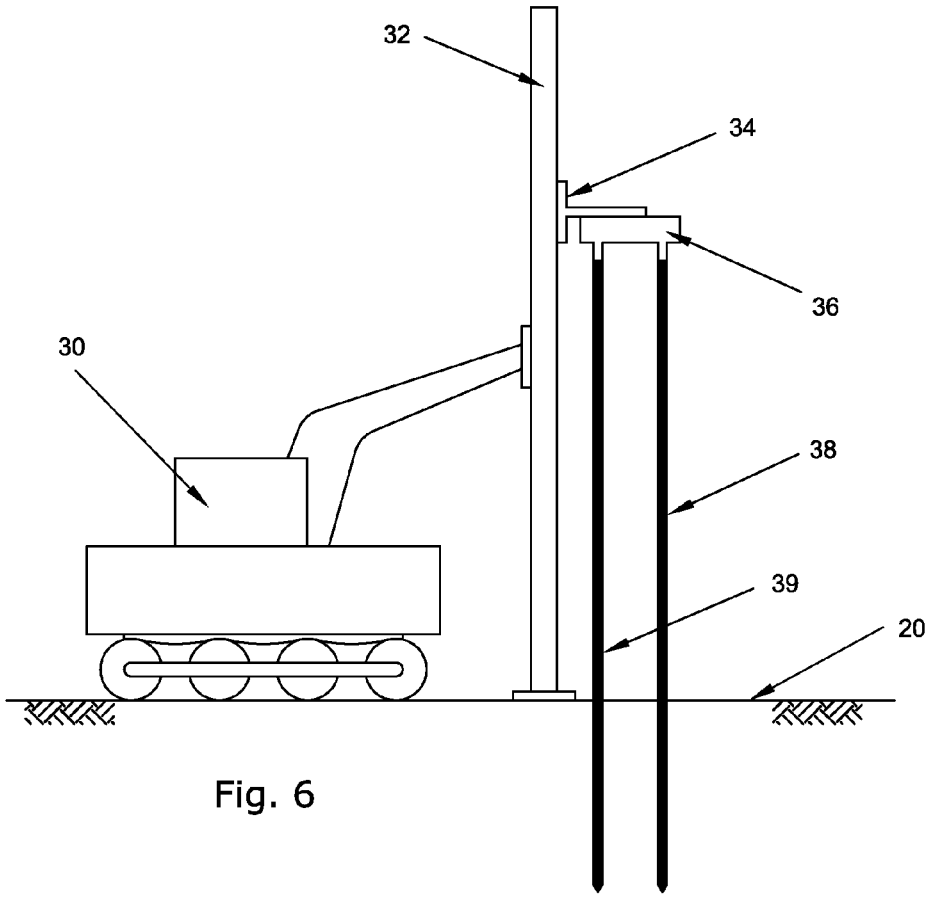
FIG. 6 is a side view of a deployment vehicle equipped with a plurality of ground improvement machines according to the present invention.
Figure 7:
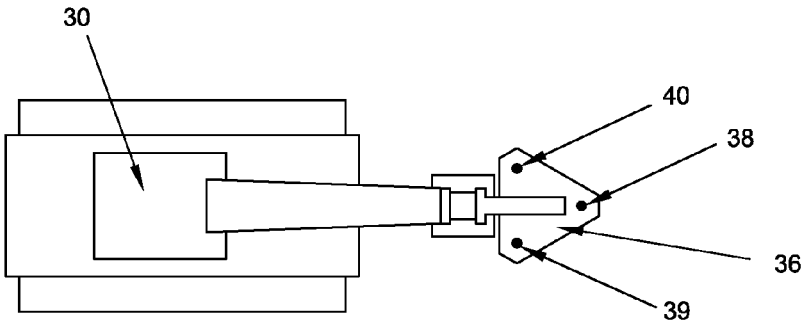
FIG. 7 is a top view of the cradle of the deployment vehicle and plurality of ground improvement machines shown in FIG. 6.
Figure 8:
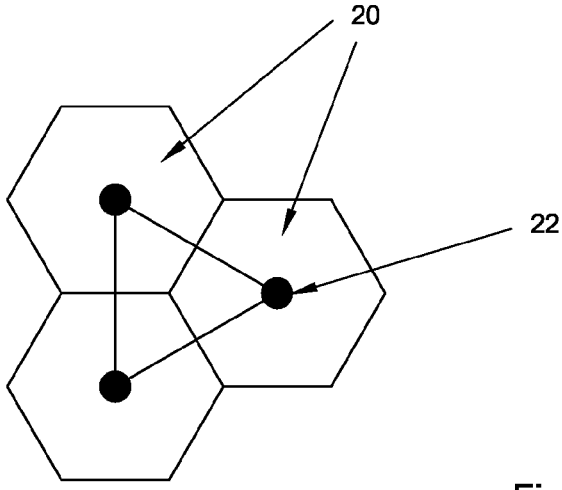
FIG. 8 is a top view showing ground affected by a single deployment of the plurality of ground improvement machines shown in FIG. 6.
Figure 9:
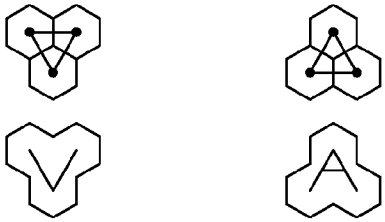
FIG. 9 is a top view showing deployment patterns for the ground improvement machines shown in FIG. 6.
Figure 10:
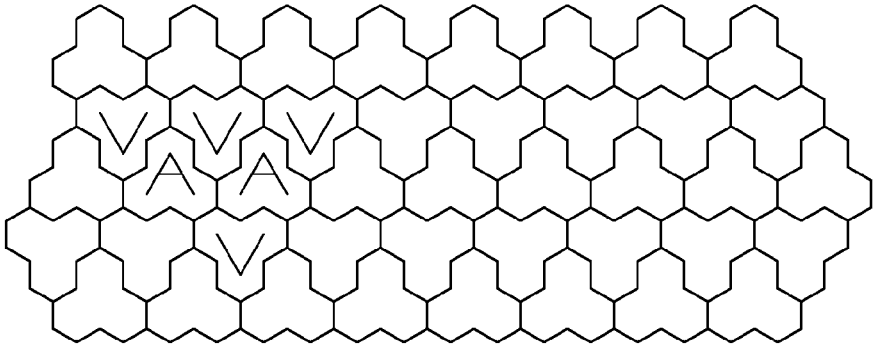
FIG. 10 is a top view showing a deployment pattern for the plurality of ground improvement machines shown in FIG. 6.

As shown in FIGS. 6 and 7, the preferred embodiment of the apparatus is when three separate treatment machines or pokers 38, 39 and 40 are structurally fixed/harnessed together by a harness 36 so that their long axes are vertical and are spaced apart in an equilateral configuration, which results in the deployment patterns shown in FIGS. 8-10. The composite structure is such that this novel apparatus may be hoisted and lowered by a vertical drive piston or drum 34 single deployment vehicle 30. This mobile carrier 30 provides the power source for all three machines 38, 39 and 40 and is designed to activate each of the machines differently and independently. Alternatively, with no degradation of the concept, three separate machines, each deployed from its own mobile carrier could be used to form the triangular array.

Improvements Proposed Herein

The mere fact that there are three independently excitable/empowered tools in the ground at the same time and in close proximity opens a whole new prospect in ground improvement technology. This is because each of the three neighbouring machines can be made to perform their functions independently, leading to many combinations of forces/influences being available to the design engineer. For instance, the vibrations emitted from each individual poker could be changed in frequency and/or phase relationship with the others. In the particular case of GI equipment described in U.S. Pat. No. 6,554,543, where both vibratory and hydrodynamic forces are employed, the possibilities to garner the benefits of handshaking between complementary energy sources which are working close enough to one another to produce synergetic effects are simply uncharted.

Again, in the case of U.S. Pat. No. 6,554,543 there is significantly increased potential for environmental enhancement of soils by virtue of having three tools at depth within the ground at the same time. Water or liquid could be either pumped into, or sucked out of, the ground by each poker either in tune with its partners, or in a cooperative manner such as to create a flow in any lateral direction between them. In comparison, having one pumped well working alone in isolation may be viewed as somewhat impotent.

How the Method would Work in Practice

The physical/mechanical operational procedures involved in deploying the hardware, of inserting the composite machine in the ground, and then improving the ground while it is being withdrawn, remain substantially the same as are currently employed with conventional GI equipment of this type.

The opportunity for differential manipulation of the excitation energies of the two functions (vibration and pumping) in the three separate sources is of course new, and how to take the best advantage of this novel aspect of the three-pronged poker would be left to the geotechnical designer, or environmental consultant, to specify/determine on a case-by-case basis.

In addition to its value as a tool for improving the engineering properties of a site, and in the particular case of U.S. Pat. No. 6,554,543 its environmental quality, there is the following specific application. The soil within the compass of the three separate prongs (machines) can be made into a very dense column which could replace the "stone-column" approach (which attempts to provide foundation support and liquefaction treatment), and here, without the need to import crushed rock.

It will be appreciated by those skilled in the art that the preferred and alternative embodiments have been described in some detail but that certain modifications may be practiced without departing from the principles of the invention.

I claim:

1. A method of ground compaction comprising:

deploying a plurality of ground improvement machines, each of the ground improvement machines comprising a tubular poker member for insertion into the ground, each said poker member adapted to internally generate vibration, the frequency of the vibration being variable, such that it may be set to vibrate at different frequencies selected by a user and each said poker member also capable of pumping water or withdrawing water as selected by said user deploying said ground improvement machines into a portion of said ground;

pumping water into the ground with at least one of said plurality of ground improvement machines;

withdrawing water out of the ground with at least one other of said plurality of ground improvement machines.

2. The method of claim 1 wherein said plurality of ground improvement machines are set to vibrate at the same or different frequencies.

3. The method of claim 1 wherein said plurality of ground improvement machines are mounted on a single deployment vehicle.

4. The method of claim 1 wherein said pumping and withdrawing of water takes place simultaneously so as to create a lateral flow of water between said at least one of said plurality of ground improvement machines pumping water and said at least one other of said plurality of ground improvement machines withdrawing water.

* * * * *